US008590727B2

(12) United States Patent
Dupuis et al.

(10) Patent No.: US 8,590,727 B2
(45) Date of Patent: Nov. 26, 2013

(54) MODULAR BERM SYSTEM AND METHOD OF ASSEMBLY

(75) Inventors: Darcy Dupuis, Devon (CA); Philip David Stasiewich, Edmonton (CA); James Stasiewich, Edmonton (CA)

(73) Assignee: Strad Energy Services Ltd, Calgary (CA)

( * ) Notice: Subject to any disclaimer, the term of this patent is extended or adjusted under 35 U.S.C. 154(b) by 137 days.

(21) Appl. No.: 13/245,848

(22) Filed: Sep. 26, 2011

(65) Prior Publication Data

US 2012/0076588 A1 Mar. 29, 2012

Related U.S. Application Data

(60) Provisional application No. 61/386,414, filed on Sep. 24, 2010.

(51) Int. Cl.
*B65G 5/00* (2006.01)

(52) U.S. Cl.
USPC ..... 220/565; 220/495.11

(58) Field of Classification Search
USPC ..... 405/107, 110, 114, 53, 52; 220/565, 220/495.11
See application file for complete search history.

(56) References Cited

U.S. PATENT DOCUMENTS 6,315,495 B1 * 11/2001 Starheim ..... 405/129.8
2009/0041543 A1 * 2/2009 Kroger ..... 405/114

* cited by examiner

*Primary Examiner* — Stephen Castellano
(74) *Attorney, Agent, or Firm* — Jean W Goodwin

(57) ABSTRACT

A modular berm system and method for installing the berm system about a containment area are provided. The berm system is formed by interconnecting a plurality of panels in an end-to-end arrangement. Corner pieces which enhance the modularity, stability and rigidity of the berm system are also provided. A continuous liquid barrier liner overlies the containment area and the supporting perimeter of panels. The liner blocks any discontinuities between panels. Discontinuities can be overlapped with flaps for protection of the liner.

48 Claims, 18 Drawing Sheets

MODULAR BERM SYSTEM AND METHOD OF ASSEMBLY

CROSS REFERENCE TO RELATED APPLICATIONS

This application claims the benefits under 35 U.S.C. 119(e) of U.S. Provisional Application Ser. No. 61/386,414, filed Sep. 24, 2010, which is incorporated fully herein by reference.

FIELD OF THE INVENTION

Embodiments described herein relate generally to a modular berm system and methods of assembly. More particularly, a plurality of panels are assembled, and joined at corners to form a perimeter berm, a liner being installed to line the enclosed are and overlay the perimeter berm, sealing any discontinuities about the perimeter.

BACKGROUND OF THE INVENTION

Earthen berms, which are also known as dams or barriers, have been used, for example, to contain oil field fluids in a confined space in order to provide a safe space for spills to collect without freely flowing into the open. Berms are intended to reduce damage to the surrounding soil and environment, and may prevent unwanted chemicals or effluents from entering the eco system.

Desirably berms are inter-connectable from a plurality of smaller modules, so that they may be easily shipped and used and reused to construct temporary safe enclosures of various desired dimensions. Inter-connectable berms in the industry today are generally made by interconnecting plastic modules.

In the oil and gas industry, tanks storing drilling fluids or muds are generally surrounded by a spill containment berm to contain any accidental spills from the tanks. Each tank can typically store upwards of 600 barrels of liquid. According to industry standards, the berm must be sized to contain at least 110% of the volume of the largest tank. While sized to standards, existing plastic berms are generally not strong enough to contain a spill resulting from ruptures or complete collapses of such tanks, being limited to only a fraction of the liquid before overturning, collapsing or blowing out. Plastic berms of several feet in height and having dovetail joints can fail with as little as about 5" of liquid in the contained area. Some plastic berms are hollow for receiving ballast water to improve performance, but even these do not meet the industry standards.

Inter-connectable berms also have inherent problems due to the gaps formed at the interconnecting points between panels. The physical gaps between panels of the berm are pathways for spills to the floor of the containment area.

Further, the height of a berm interferes with access to the contained area, resulting in the use of stiles and running hoses and pipes over the top.

There is a demonstrated need for module berms capable of meeting industry standards.

SUMMARY OF THE INVENTION

Embodiments described herein are directed to a modular berm system comprising a continuous liquid barrier layer between discontinuities in an enclosing upright wall of the berm and floor of a containment area formed by the berm to prevent contamination of the floor by undesirable fluids seeping through gaps or discontinuities in the enclosing upright wall.

Embodiments described herein are also directed to a corner piece for interconnecting two panels of the berm arranged at an angle.

Accordingly in one broad aspect a modular berm system is provided comprising a plurality of modular panels, each panel having a top edge, a base and opposing connecting ends defining a supporting surface therebetween, the panels interconnected at the opposing connecting ends of adjacent panels to form an upright perimeter wall resting upon the base on a floor of a containment area enclosed by the perimeter wall. A liner overlies the floor and the supporting surfaces of the perimeter wall to form a substantially continuous liquid barrier for retaining liquids isolated from the floor and within the containment area, the liner further extending over the top edge of the panels. A plurality of fasteners for retaining the liner to the top edge of the panels. One form of retainer is a clamp.

Accordingly in another broad aspect 20 a method for installing a berm system is provided comprising forming a perimeter wall enclosing a containment area by arranging a plurality of panels in an end-to-end relationship, each panel having a base, a top edge and a supporting surface, the panels interconnecting at connecting ends. Then one overlies the floor of the containment area with a liquid barrier layer, extending the liquid barrier layer over the supporting surfaces and top edges of the plurality of panels; and finally retaining the liquid barrier layer to the top edge of the plurality panels.

DETAILED DESCRIPTION OF THE PREFERRED EMBODIMENTS

Herein, embodiments are directed to a berm system and method for assembling the berm system. As discussed below, embodiments of the modular berm system include means for forming a liquid barrier, interconnection of modules, interconnection at corners of modules, and access across the berm for hoses and the like.

Figure 1A:
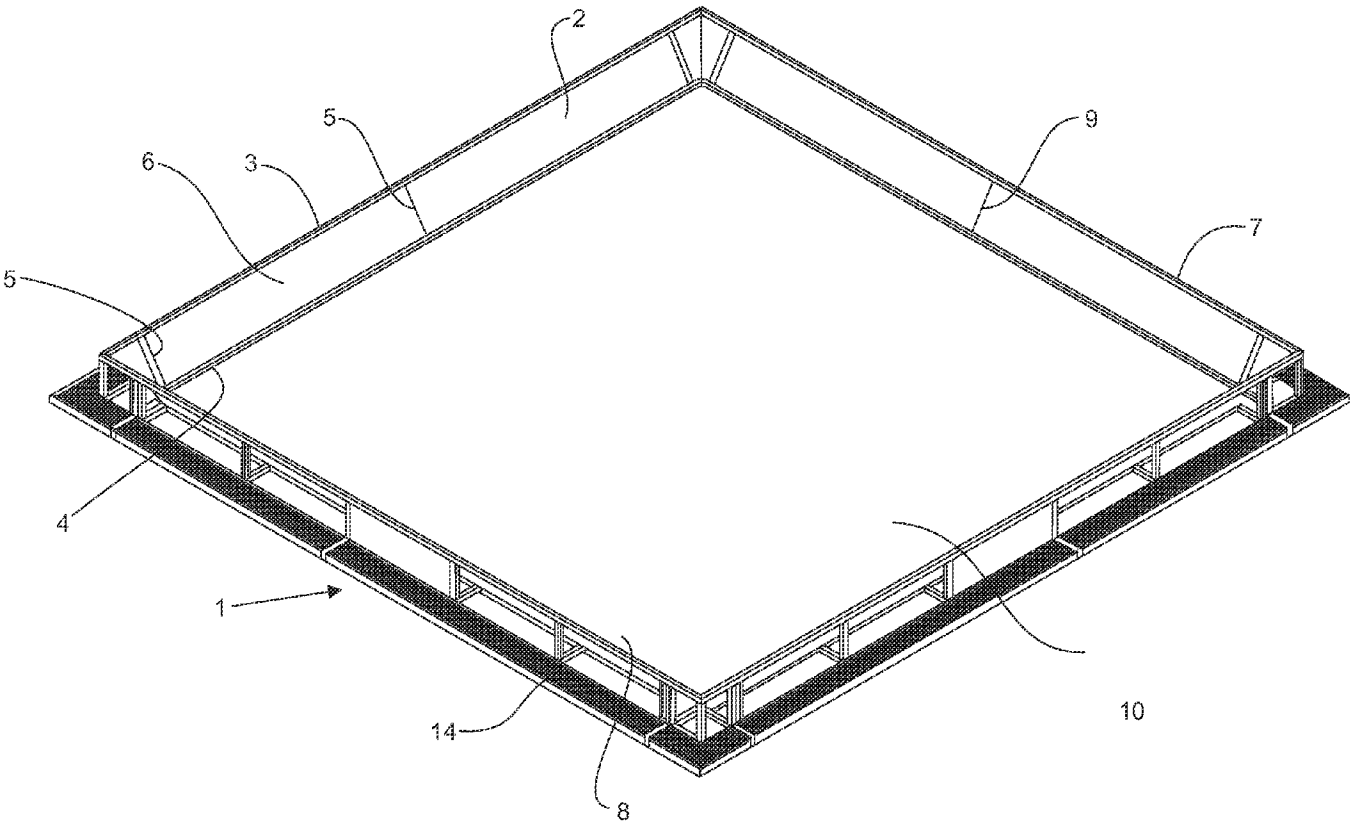
FIG. 1A is a perspective view of a modular berm system in its assembled form according to one embodiment without a liquid barrier layer.
Figure 1B:
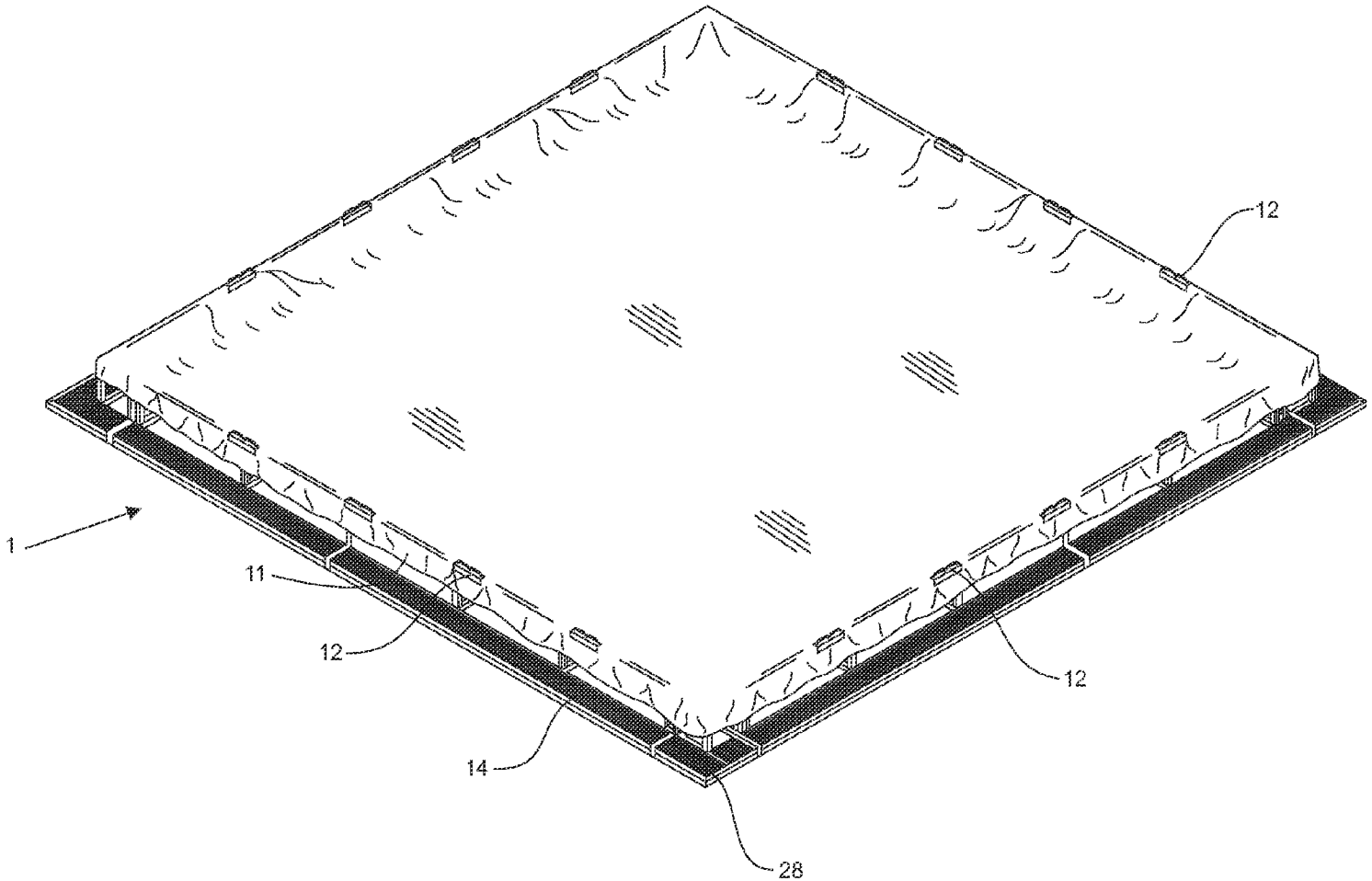
FIG. 1B is a perspective view of the berm system of FIG. 1 with the liquid barrier layer.
Figure 1C:
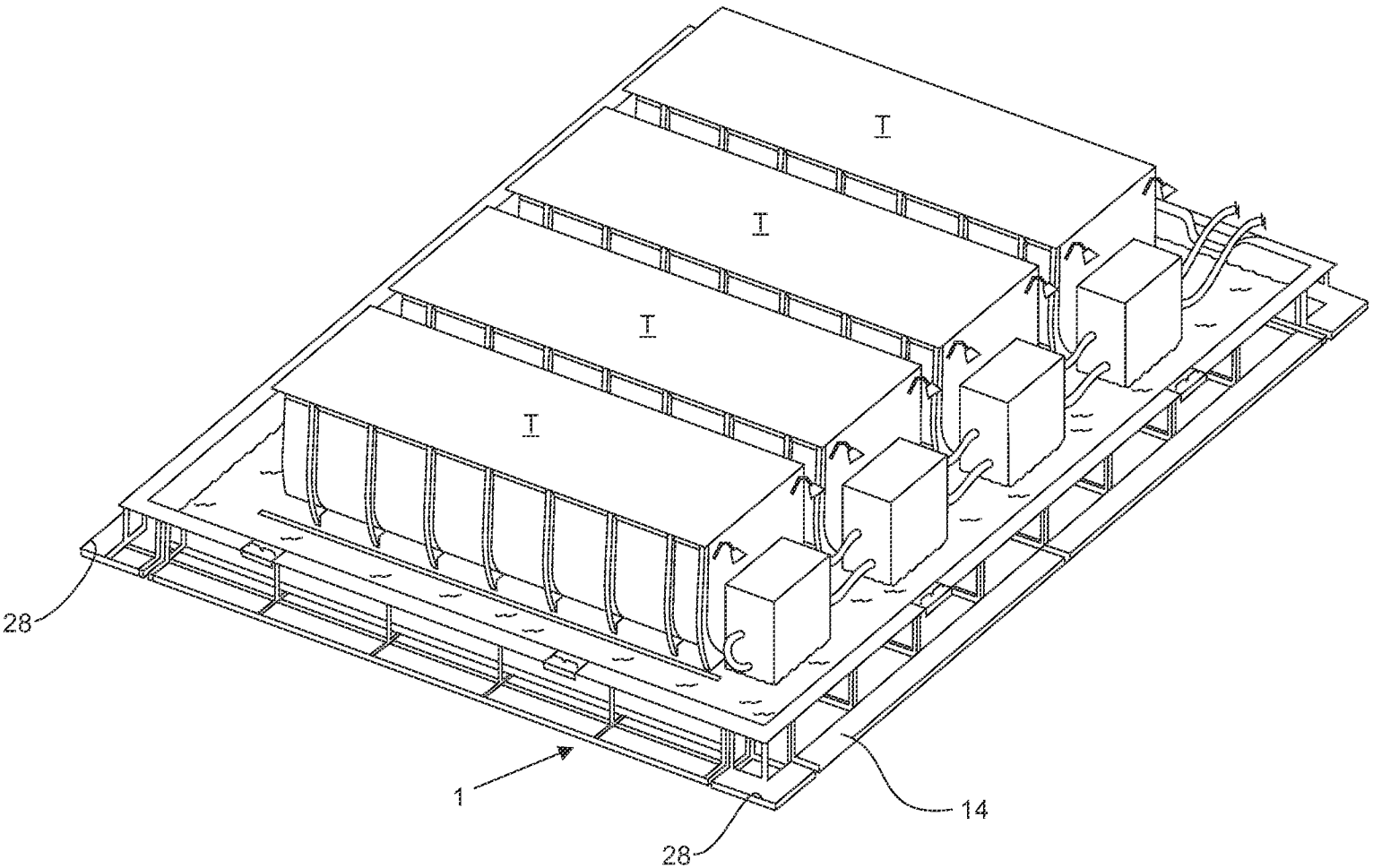
FIG. 1C is a top perspective view of a tank farm comprising a plurality of storage tanks surrounded by the berm system of FIG. 1A.
Figure 2:
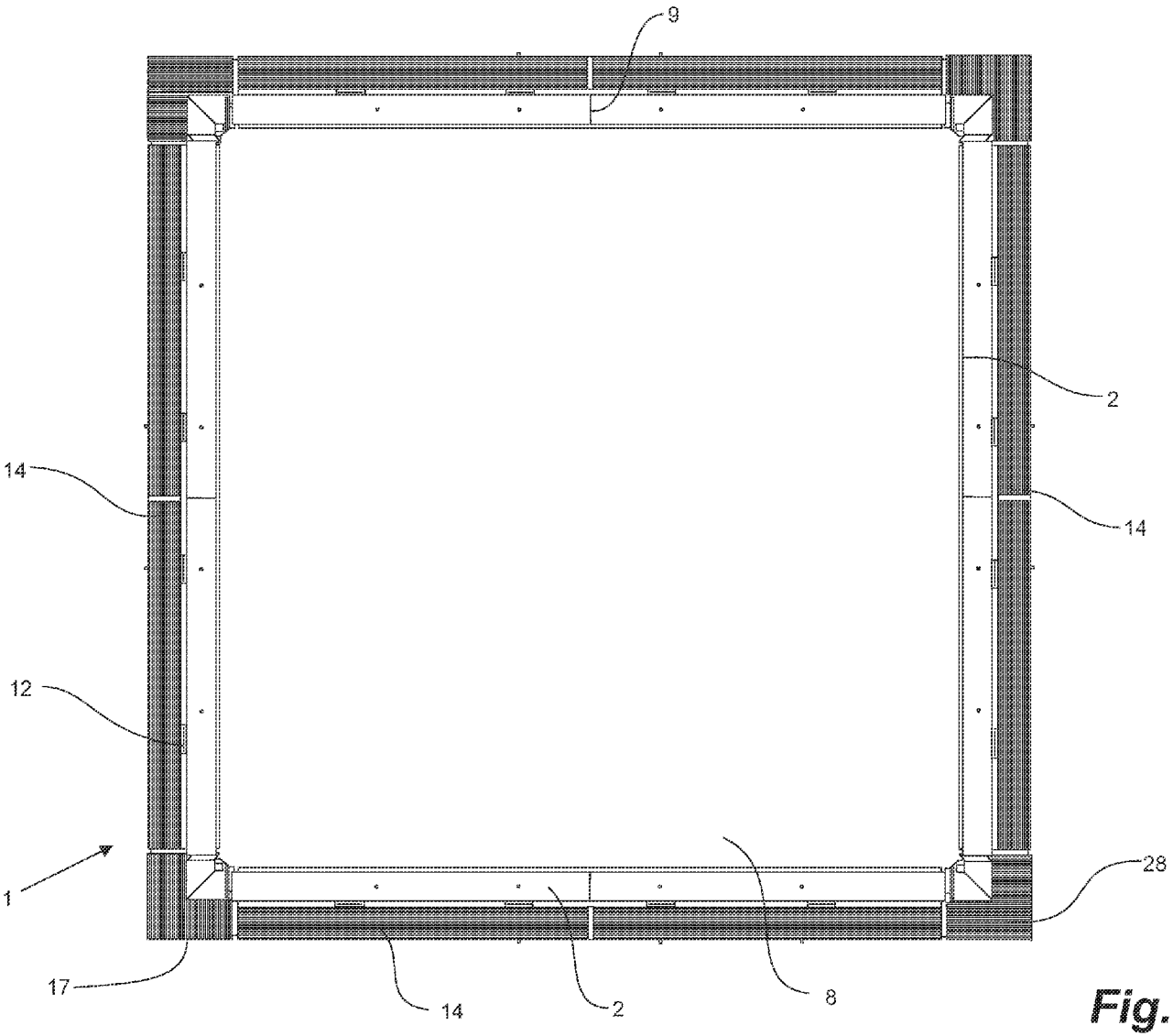
FIG. 2 is a top view of the modular berm system of FIG. 1.

FIGS. 1A to 2 illustrate one embodiment of a modular berm system 1 surrounding tanks for containing liquids, such as that from collected rainwater or liquid leaking from the tanks or machinery therein. The berm system comprises a plurality of modules, each module being a rigid panel 2. Each rigid panel 2 has a structural cross-section to resist hydraulic loads and comprises a top edge 3, a base or a bottom edge 4 and opposing connecting ends 5. The plurality of panels 2 are arranged in an end-to-end arrangement for interconnection at their connecting ends 5 to form an upright wall 7 enclosing a containment area 8. The containment area has a berm floor, generally the ground beneath the tanks. Facing the containment area 8, a supporting surface 6 extends between the top edge 3 and the base or bottom edge 4 and between the opposing connecting ends 5,5. The panels 2 themselves can have some discontinuities 9 and interconnection of the panels 2 can result in discontinuities 9 in the support surface such as at the interface of the connecting ends 5,5. The discontinuities 9 form a leak path to the floor 10 of the containment area 8 through which liquid can pass. Accordingly, the berm system 1 further comprises a liquid barrier layer or liner 11 which overlies the floor 10 of the enclosed containment area 8, the discontinuities 9 and the enclosing upright wall 7 to form a substantially continuous liquid barrier between the discontinuities 9 and the floor 10 of the containment area 8. In one embodiment, the liner 11 is a flexible, reinforced polyethylene (RPE) sheet. A suitable RPE liner is about ¼ inch thick.

The panels 2 themselves, and as assembled in the berm system 1, are a form of gravity retaining wall (See FIG. 5C), suitably rigid for resisting the hydraulic pressure of the contained liquids. The cross-section structure of the panels, for resisting overturning, can be calculated by those of skill in the art, using techniques such as the coulomb wedge analysis. A typical cross-section is a trapezoid. Herein a substantially triangular cross-section is used with optional extensions, used advantageously as walkways.

Figure 3:
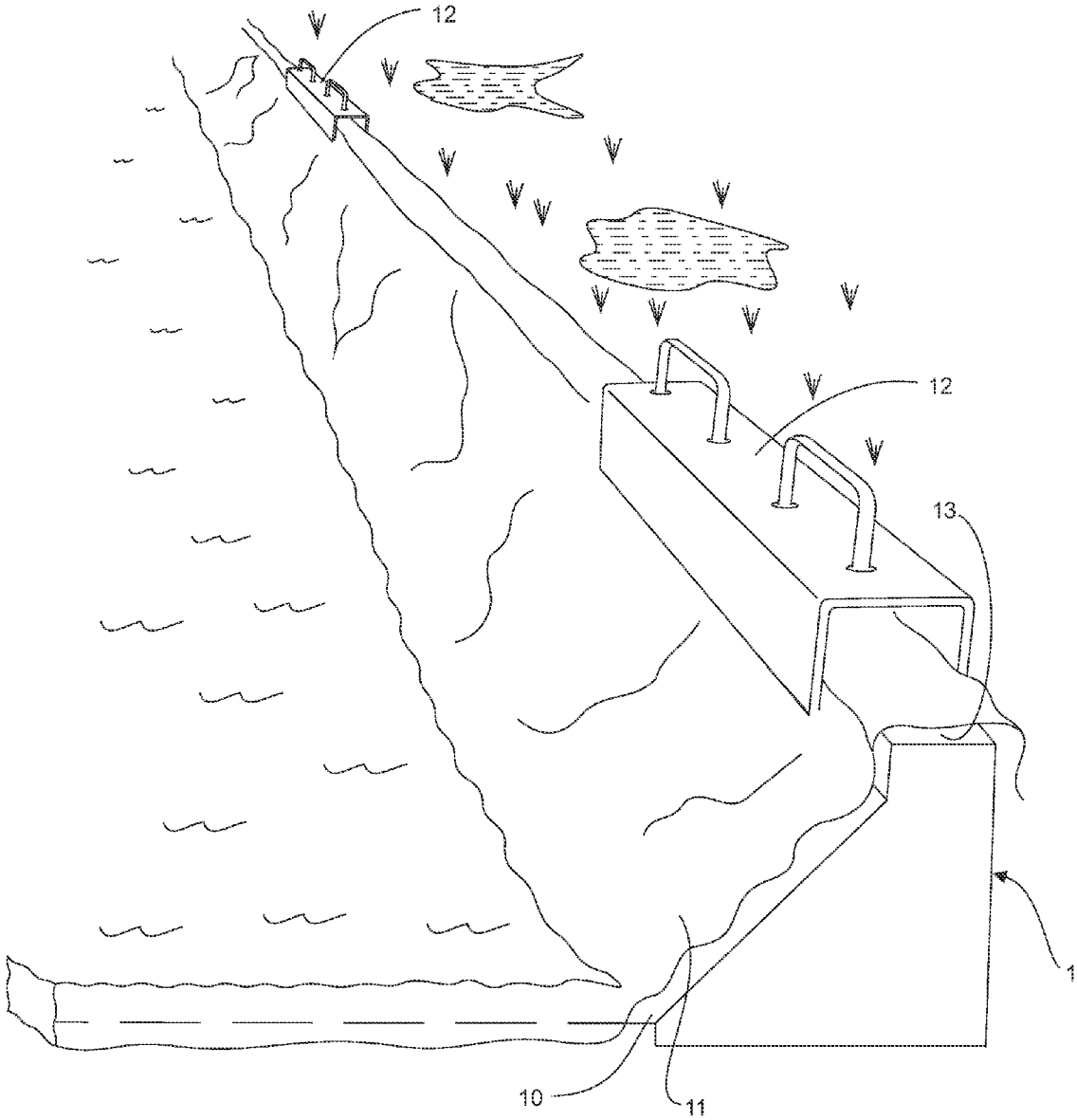
FIG. 3 is a partial perspective view of an enclosing upright perimeter wall of the berm of FIG. 1A illustrating clamps retaining or holding the liquid barrier layer in place over the top edge of the interconnected panels.

In one embodiment, and as seen in FIG. 3, the liner 11 extends across the floor 10 and over the wall 7. Along the wall 7, the liner 11 extends over the top edge 3 of the panels 2 and is held in place by a plurality of clamps 12 spaced along the top edge 3. Each clamp pinches the liner 11 to the top edges and comprises two legs 12*a* and 12*b* depending from a base surface 12*c*. The width between the two depending legs 12*a* and 12*b* cooperates with a width of the top edge 3 of the panels 2 so that the clamp 12 can straddle the top edge 3 of the panels 2 and sandwich the liquid barrier layer between the top edge 3 of the panels 2 and the legs 12*a* and 12*b*.

In one embodiment, the plurality of panels 2 are a series of linear panels 2 connected together to form a straight portion of the wall 7. The supporting surface forms a planer supporting surface. Accordingly, some panels, at least three corner interconnections, are arranged at an angle so as to close the wall 7 in a perimeter. Either the panels themselves form the corner interconnections or separate corner pieces are provided. Corner interconnections or corner pieces 17, described below, connect between the connecting ends 5 of two adjacent panels 2 to form a closed perimeter wall 7 and closed containment area 8. The corner pieces 17 also provide increased rigidity to the berm system 1. The berm system 1 formed by the panels forms a strong structure around the containment area 8.

FIG. 1C illustrates a typical arrangement of a plurality of tanks T within the containment area 8. The liner 11 prevents spills of saline, oils or fluids from the machinery, tanks and motor vehicles which move along or sit inside the containment area 8 from reaching the floor 10 of the containment area 8 and environment without. Hydraulic forces of contained liquids force the liner 11 against the enclosing upright perimeter wall 7. As the barrier layer 11 is forced against the supporting surface 6 of the enclosing upright wall 7, the discontinuities 9 in the enclosing upright wall 7 are spanned by an uninterrupted liquid barrier layer directly adjacent them. This prevents leakage of liquids to the floor 10 of the containment area 8.

Figure 5A:
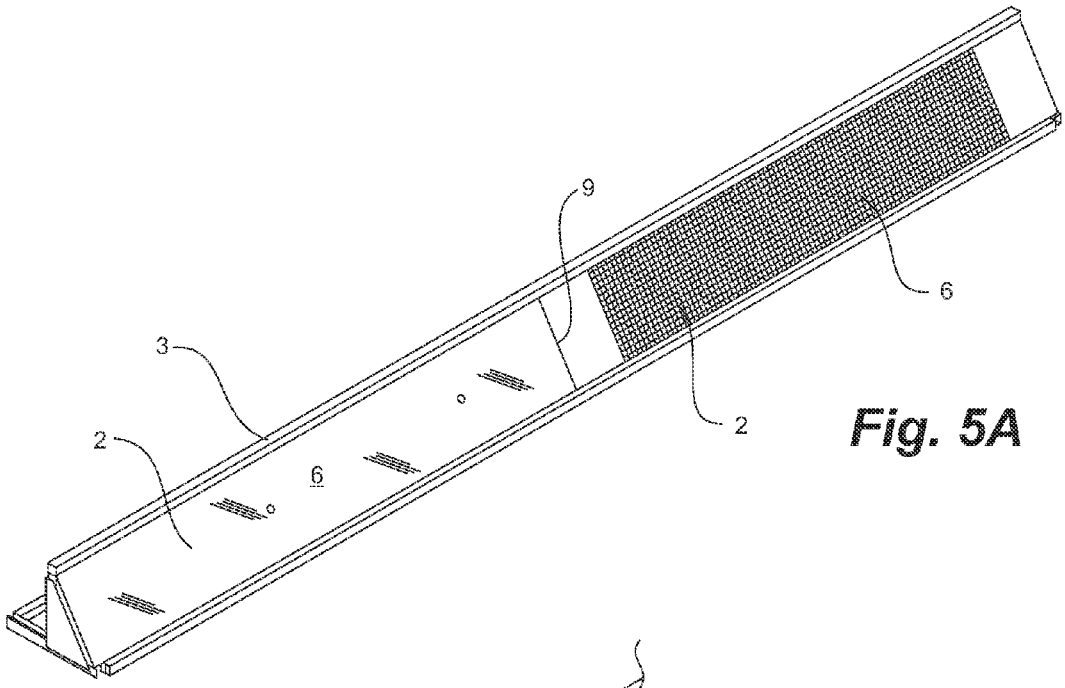
FIG. 5A is a partial view of two connected panels of the enclosing upright wall of the berm of FIG. 1, the supporting surface facing the containment area.
Figure 5B:
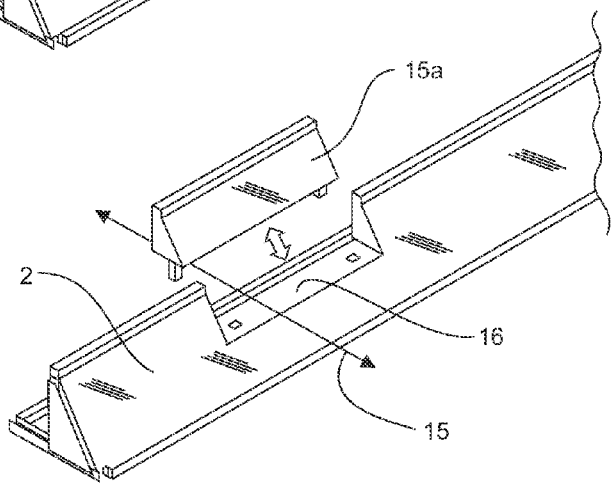
FIG. 5B is a partial view of a panel according to FIG. 5A which incorporates a doorway, sill and removable door.
Figure 5C:
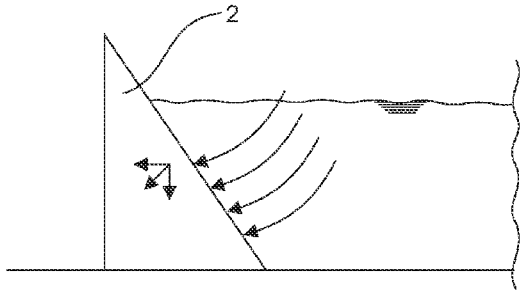
FIG. 5C is a schematic illustrating one embodiment of a structural cross-section of the panel of FIG. 5A.

In one embodiment and as seen in FIGS. 5A and 5C, the panels 2 have a structural cross-section to resist hydraulic loading from the containment area. The panel is made of structure material, such as metal or composites. Steel is an economical choice of material. One suitable cross-section is one incorporating triangular trusses or supports. As shown, a triangle cross-section orients the surface 6 sloped upwardly and outwardly from the bottom edge 4 of the panels 2, away from the containment area 8. The sloped supporting surface 6 firstly provides a supporting surface for the liner 11. Secondly, the surface 6 results in a vertical force vector (FIG. 5C) for stabilizing the wall 7 while the panel structure also resists the horizontal vector from any contained liquid. Further, the sloped planar surface also increases the size of the containment area 8 as the level of any contained liquid rises.

In one embodiment and as seen in FIG. 1A, the panels are interconnected by connection means located at the connecting ends 5 of the panels 2. One form of connection means is as described for rig mat interconnection set forth in US Patent Application Publication Nos. US 2009/0301004 to Dagesse and US 2009/0297266 to Stasiewich.

Herein, the opposing connecting ends 5 comprise cooperating and opposing U-shaped channels extending along the connecting edges, one channel having its recess oriented upwardly and one having its recess inverted, or oriented downwardly. A rigid panel will have one connecting edge 5 with an upward facing channel and the opposing connecting edge 5 having a downward facing channel. The channels interlock to prevent adjacent, connecting panels 2 from pulling apart.

Further, in one embodiment and as seen in FIGS. 1A to 2, each panel 2 comprises a rigid personnel platform 14 extending outwardly from about the base or bottom edge 4 of the panel away from the containment area. When the module berm system is assembled, the platform 14 forms a substantially continuous walkway around the enclosing upright wall 7 after the panels 2 are interconnected to form the berm system 1. As the platform 14 is connected or integral with panel 12, the platform 14 does not move or shift. The platform forms a safe passageway for personnel working around the berm system 1 irrespective of the shifts and changes to the terrain below.

In one embodiment, in a conventional manner, lines or hoses 40 can be run into the containment area 8 over the top edges 3 of the panels 2.

Figure 4:
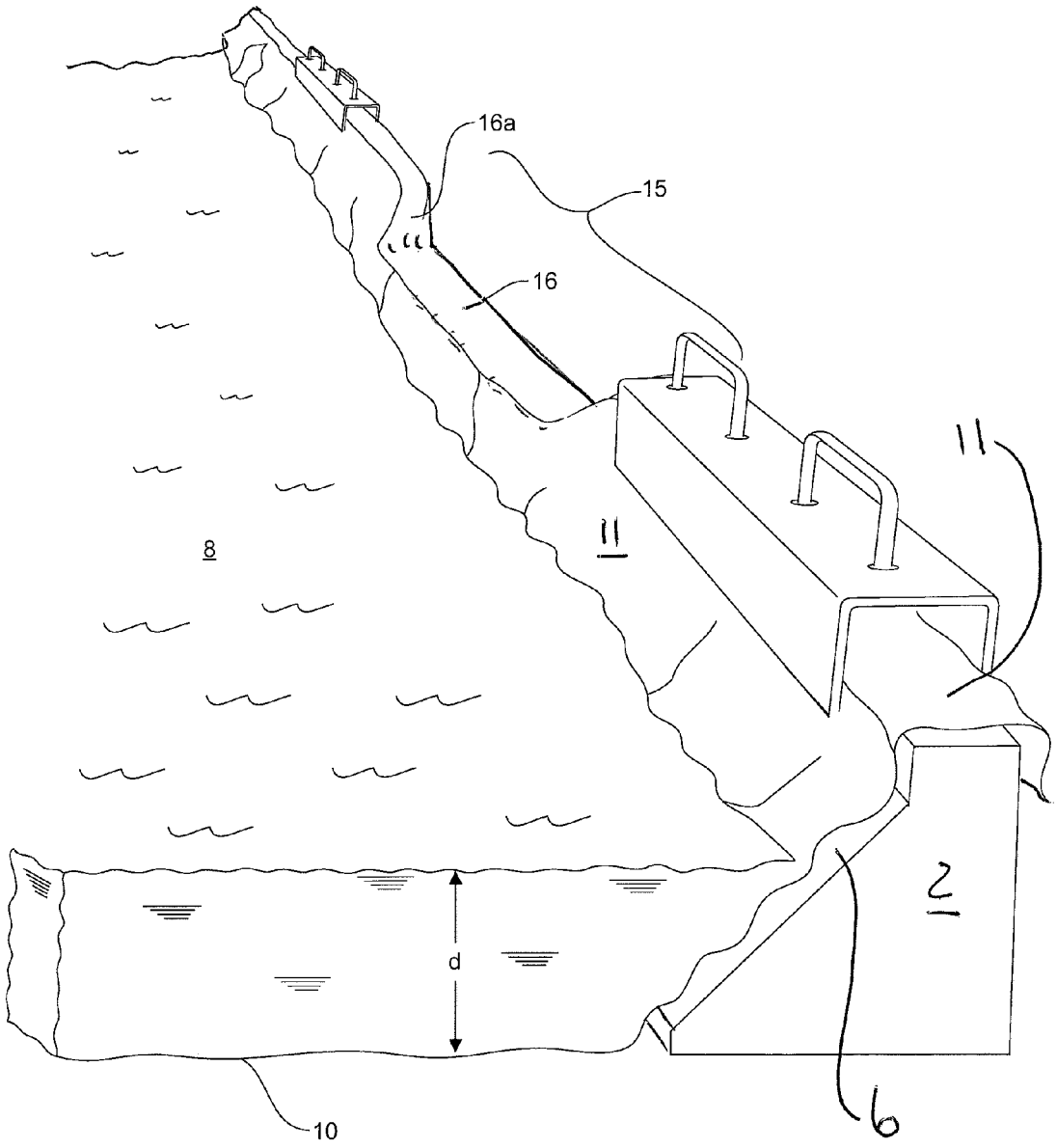
FIG. 4 is a partial perspective view of an enclosing upright perimeter wall having a doorway access in a panel of the enclosing upright wall for running lines into a containment area.

In another embodiment and as seen in FIGS. 4 and 5B, one or more of the panels 2 forming the enclosing upright wall 7 comprise a doorway 15 for access to the containment area 8. Such an access panel has a door frame 16*a* and a sill 16 spaced above the floor 10 of the containment area 8 to provide a minimum containment depth d in the containment area 8. Lines or hoses 40 can be run into the containment area 8 through the doorway 15. As a minimum containment depth d is provided by the sill 16, when needed, the hoses 40 can be lifted or disconnected and the doorway 15 can be closed with insert or door 15*a* to restore the access panel to a regular panel 2. The liquid barrier extends over the closed doorway 15 and is indistinguishable in function and appearance as described for other panels 2.

With reference to FIGS. 1B and 5A, in one embodiment, the berm system 1 is assembled as follows: the panels 2 are arranged in an end-to-end relationship and interconnected at their connecting ends 5 to form the enclosing upright wall 7 (as seen in FIG. 5) forming a perimeter around the containment area 8. Interconnection of the panels 2 can result in discontinuities 9 at the connecting ends 5. The liner 11 is laid over the floor 10 of the containment area 8 and is extended over the planar surface 6 of the enclosing upright wall 7, over any discontinuities 9, and over the top edges 3 of the panels 2. That portion of the liner 11 extending over the top edge 3 is fastened or retained thereto by fasteners such as clamps 12.

In one embodiment, a pair of panels 2 are arranged at a corner angle around the containment area 8 and are joined together by corner pieces 17 shown in FIGS. 6A to 8E.

Further, the corner pieces 17 provide increased stability to the berm system 1 as they are securely connected to the panels 2 and arranged at an angle to prevent movement of the corner piece away from the panels 2. The corner pieces are also designed such that they can be easily disconnected from the panels 2. This enables easy dismantling of the berm system 1 for easy of transport and reuse. The corner pieces 17 are also equipped with flaps for covering the discontinuities 9 formed between the panels 2 and the corner pieces 17 to preventing extrusion of the liner therethrough, failure and leakage of contained liquid through the discontinuities 9.

Figure 6A:
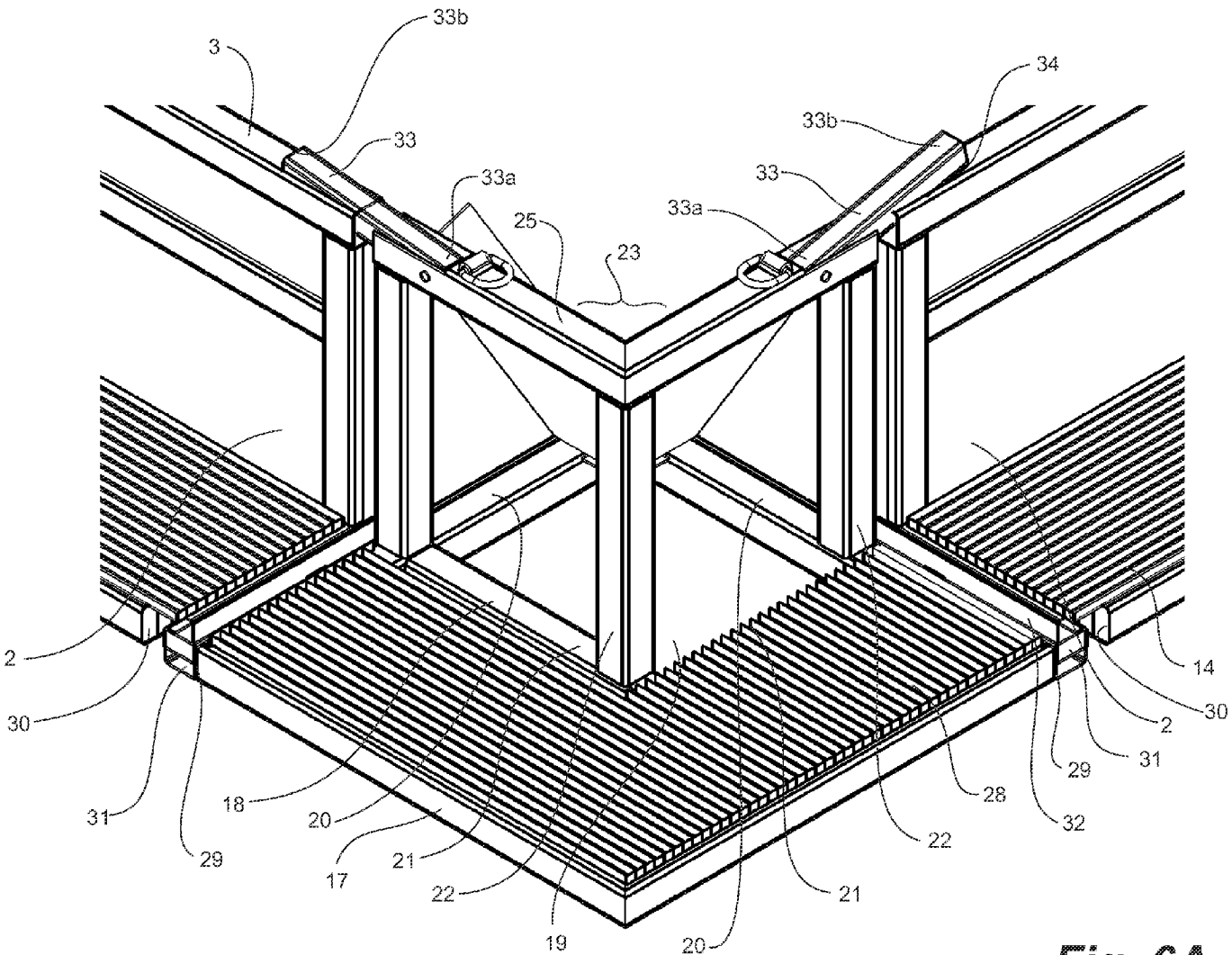
FIGS. 6A to 6C are perspective views illustrating one embodiment of a corner piece, more specifically.
Figure 6B:
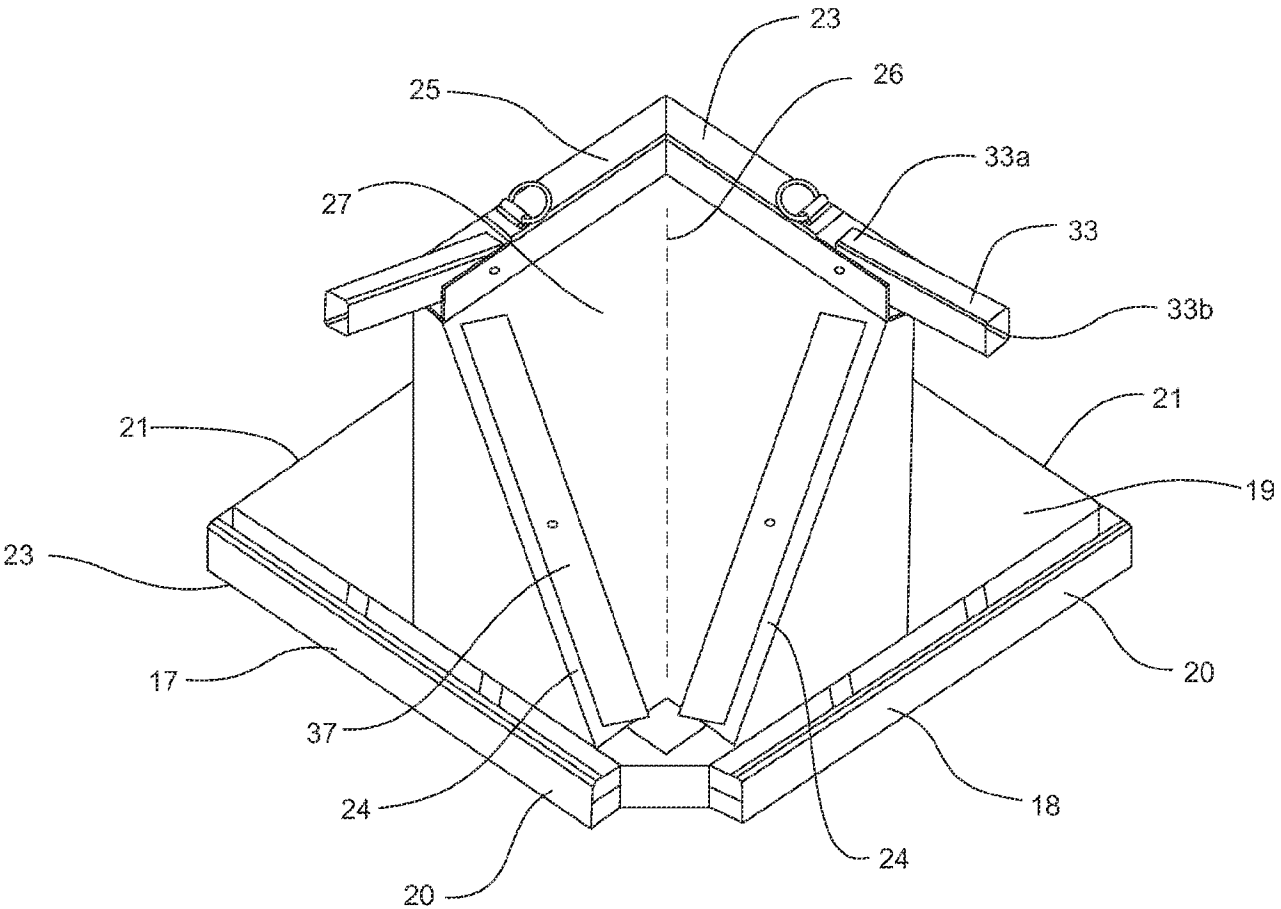
Figure 6C:
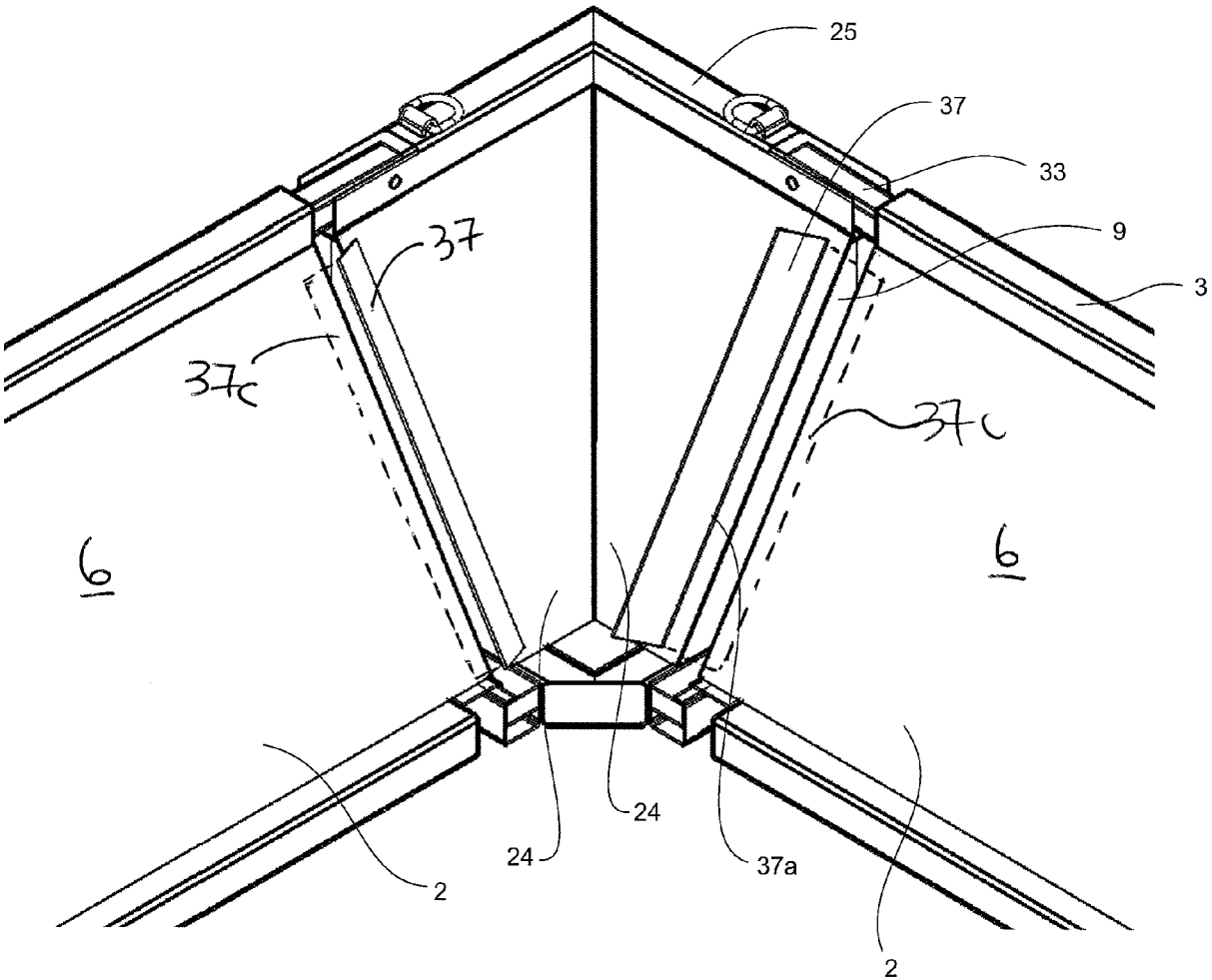

FIGS. 6A to 6C illustrate one embodiment of a corner piece 17. The corner piece 17 is interlocked with the rigid platform 14 extending outwardly from the bottom edge 4 of the two panels 2 using a first interlock means 50. Embodiments utilizing a separate corner piece 17 comprise a frame 18 having a base portion 19 defined by two interconnecting edges 20,20 and at least an exterior edge 21. The two interconnecting edges 20,20 interface to adjacent ridge panels 2,2 at an interconnecting corner.

In an embodiment, the base portion 19 is rectangular and the two interconnection edges 20,20 are interior edges and the at least one exterior edge comprise two exterior edges 21,21. The two interior edges 20,20 are at right angles for forming a square corner. Four corner pieces are employed to form a rectangular perimeter. The frame 18 further comprises wall supports 22,22 extending upwardly from the two exterior edges 21,21. Where the corner is at 90 degrees, the corner is an L-shaped corner 23. The frame 18 further comprises two sloped planar surfaces 24,24 (best seen in FIG. 6B) extending from top edge 25 of each of the two wall structures 22,22 towards the base portion 19 and meeting at about a interior corner of the base portion. The two sloped planar surfaces 24,24 meet along an common abutting interface 26 to form a substantially continuous sloped surface 27. The corner piece 17 is located between the two adjacent panels 2 and is connected to the two panels 2 using the first interlock means at exterior edges 21,21 and connecting ends 5. In other words, 12. The modular berm system comprises a frame having a base portion having a first side connecting edge and a second side connecting edge arranged at a corner angle, a first top edge and a second top edge, the first top edge and first side connection edge arranged at a corner angle to the second top edge and second side connection edge respectively, two supporting surfaces extending from the top edges to the base and meeting along an interface to form a substantially continuous supporting surface, a first interlock along the first side connecting edge and the second side connecting edge wherein the first interlock releasably connects to one panel of the pair of panels and the second interlock releasably connects to the adjacent panel of the pair of panels for forming a corner of the perimeter.

As is the case with the panels, the corner 17 can include rigid platform 28 for cooperating with the platform 14 of the panels 2 for forming the continuous walkway about the corner. The first interlock means extends along the rigid platform 28 extending outwardly from about the two exterior edges 21,21 of the corner piece 17. The rigid platform 28 has two connecting ends 29,29 facing the connecting ends 30,30 of the platform 14 of the two panels 2. Each connecting end 29 of the rigid platform 28 has a first U-shaped channel 31 along the connecting end 29. Each connecting end 30 of the rigid platform 14 has an inverse U-shaped channel 32 along the connecting end 30. The corner piece 17 is connected to the rigid panel 2 by inserting the first U-shaped channel 31 into the second inverse U-shaped channel 32. Connecting the corner piece 17 with the two panels 2 aligns the top edges 25 of the corner piece 17 with the top edges 3 of the panels 2. A substantially continuous walkway is formed about the perimeter wall wherein each panel and corner piece has a platform extending outwardly from about the base of the panels and the base of the corner pieces, and away from the containment area.

With reference to FIGS. 6A to 8E, the corner piece 17 further comprises the second interlock 52 to prevent lateral movement of the interface of the corner piece 17 with the panels 2 after the base of the corner piece 17 is interlocked with the panels 2.

With reference to FIGS. 6A to 6C, one embodiment of the second interlock comprises a longitudinal bar 33 for bridging cooperating channels along the top edge 3 of the panels 2 and top edge 25 of the corner piece 17. To prevent loss of the bar during relocation of the berm system 1, the bar 33 can have one end 33*a* hinged to the top edge 25 of the corner piece 23 so as to remain pivotally attached thereto and whose other end 33*b* is received by a recess 34 provided in a channel form on the top edge 3 of the rigid panel 2. Location of the end 33*b* in the recess 34 prevents lateral movement of the corner piece 23 relative to the panels 2.

Figure 7A:
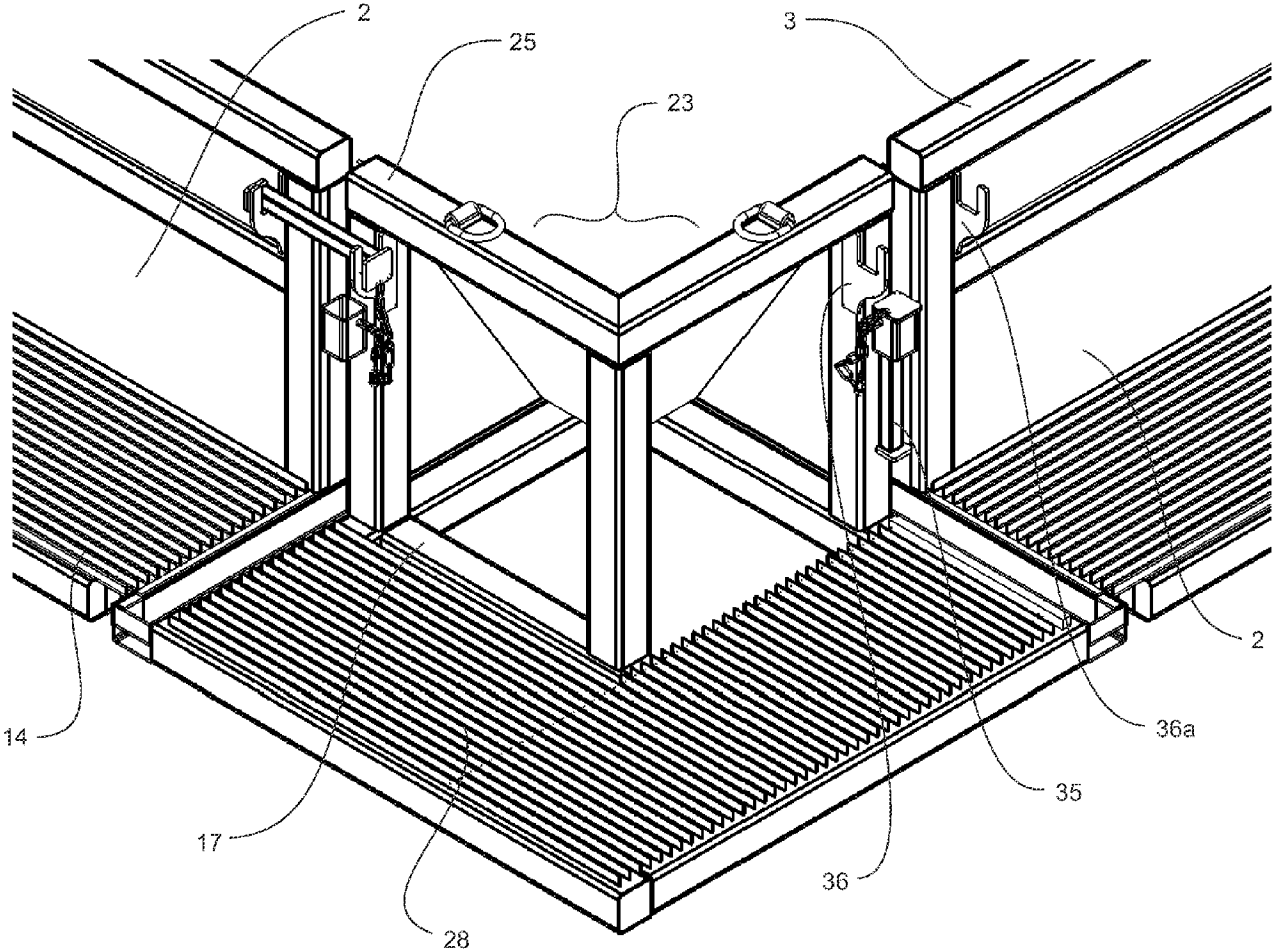
FIGS. 7A to 7C are perspective views illustrating another embodiment of a corner piece.
Figure 7B:
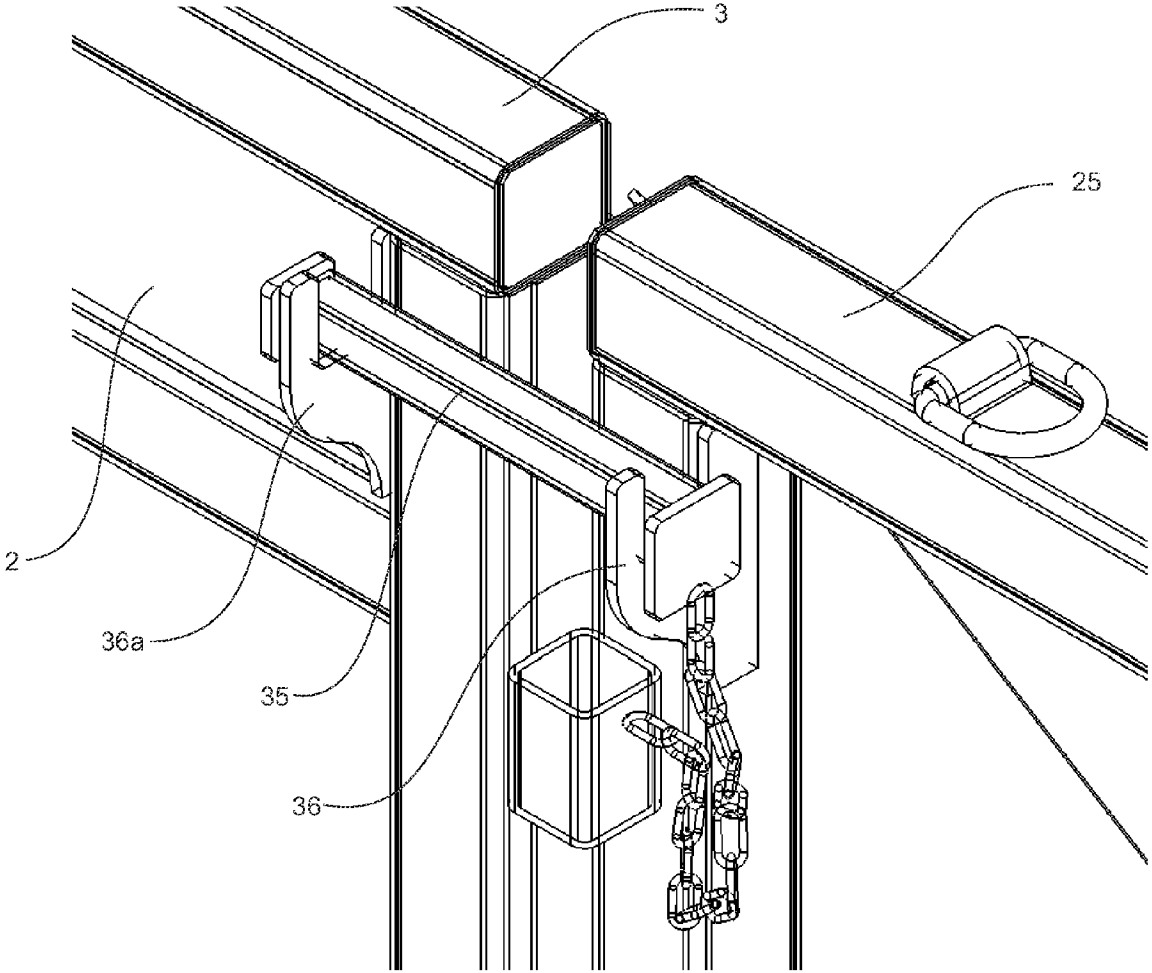
Figure 7C:
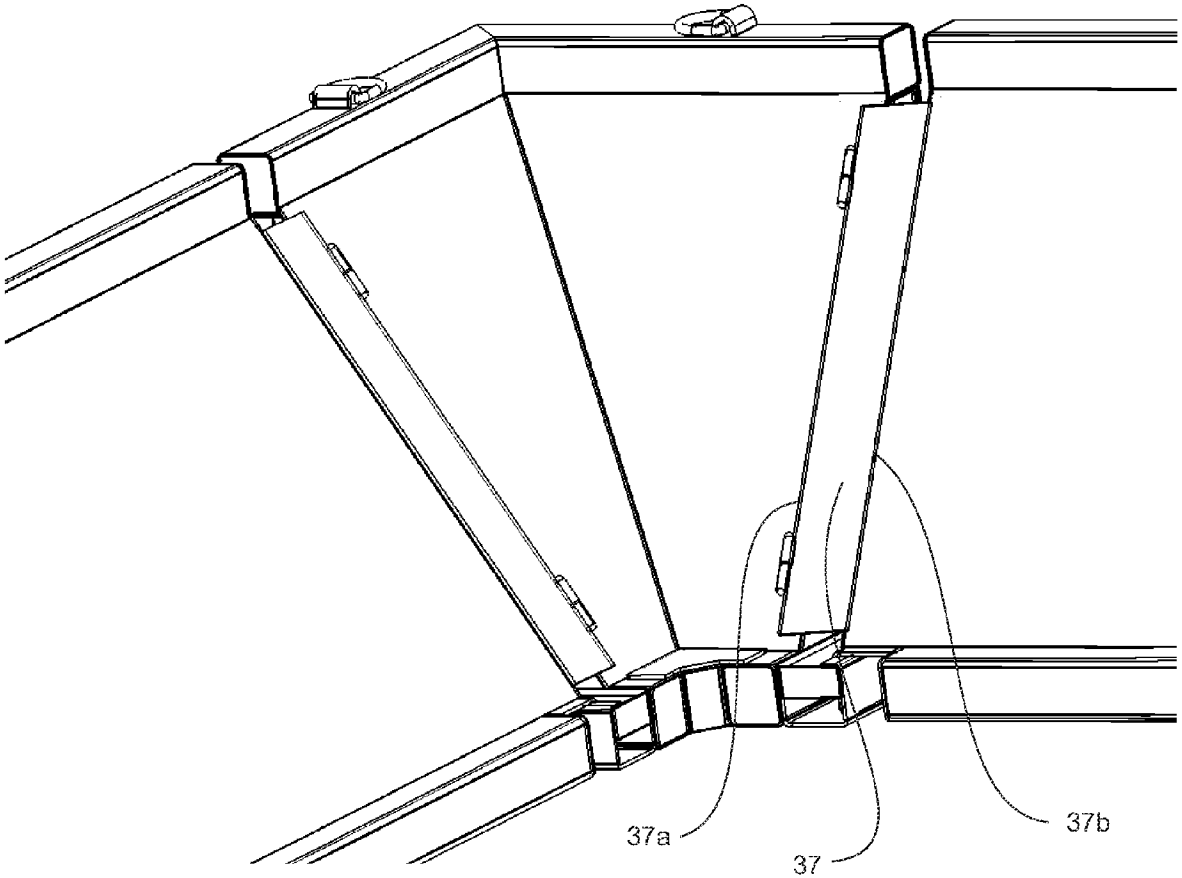

FIGS. 7A to 7C illustrate another embodiment of the second interlock means 52. The second interlock comprises a pair of hooks 36,36*a*, one each side of the interconnection and configured to accept a bar or rod 35. Movement of either panel 2 or corner piece 23 is resisted by the limited movement of the rod 35 in the hooks 36,36*a*. The rod 35 has a first end 35*a* configured to be located in the first hook 36 located on the wall support 22 of the corner piece 23. A second end 35*b* of the rod 35 is configured to be located in the second hook 36*a* located on the rigid panel 2 adjacent and spaced from the first hook. Placement of the rod 35 in the two hooks 36 and 36*a* limits lateral movement of the corner piece 23 with the panels 2. As shown in FIG. 7B, to avoid loss of the rod during relocation to a new berm site, the rod is attached with a flexible retainer, such as a chain 35*a*. The rod can also be stored in a holster fit to the panel 2 or corner piece to which the chain 35*a* is secured.

Having reference to FIGS. 6B and 6C, the corner piece 23 further comprises a flap 37 for covering the discontinuity 9 formed at the connecting ends of the sloped wall 24 and the rigid panel 2 after the corner piece 17 is interlocked with the rigid panel. One edge 37*a* of the flap 37 is attached to the sloped wall 24 and the other edge 37*b* of the flap 37 rests on the planar surface 6 of the rigid panel 2 for covering the discontinuity (best seen in FIG. 7C). In one embodiment, the edge 37*a* of the flap 37 is hinged to the sloped wall 24 for moving to a discontinuity-covering position 37*c* (dotted lines) after assembly.

Figure 8A:
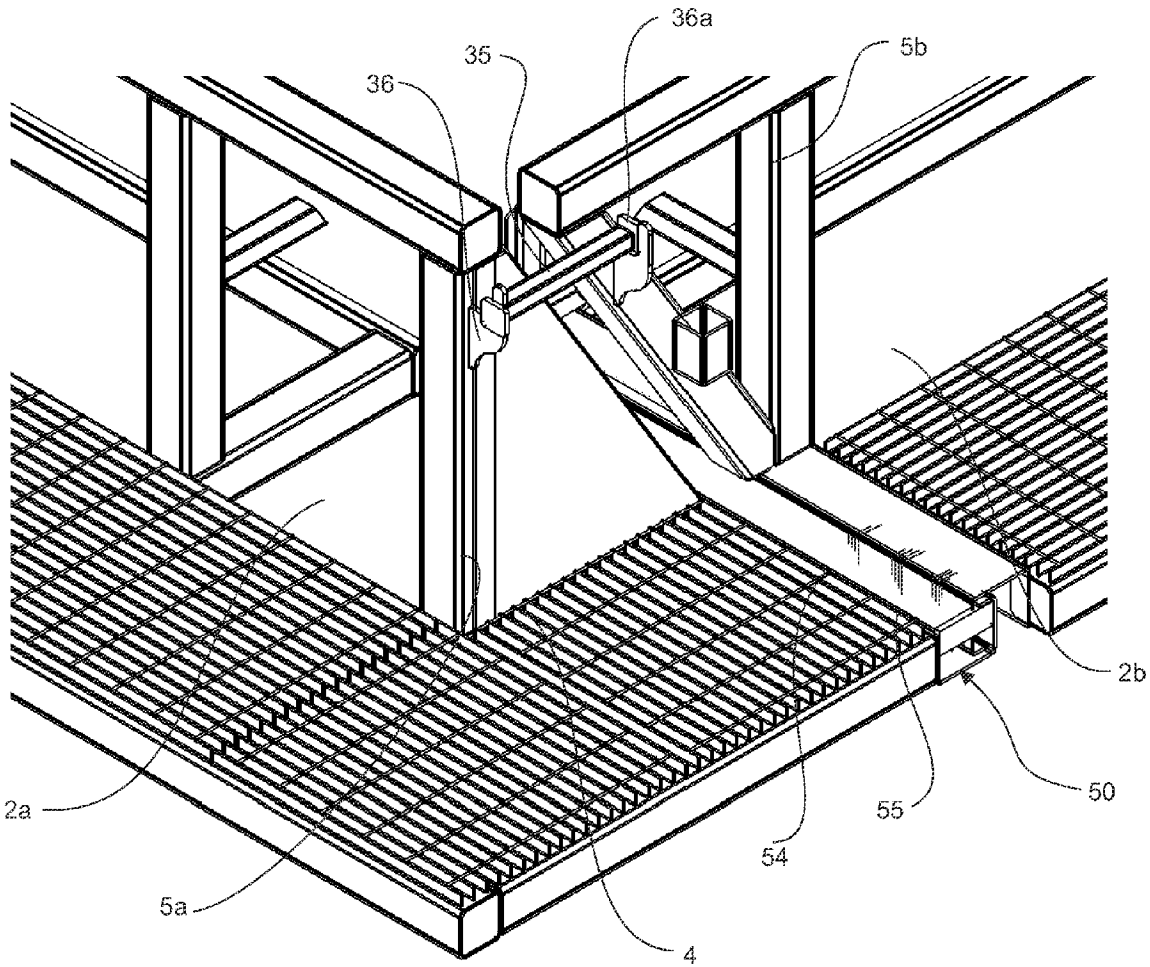
FIGS. 8A to 8E are perspective views illustrating another embodiment of a corner piece.
Figure 8B:
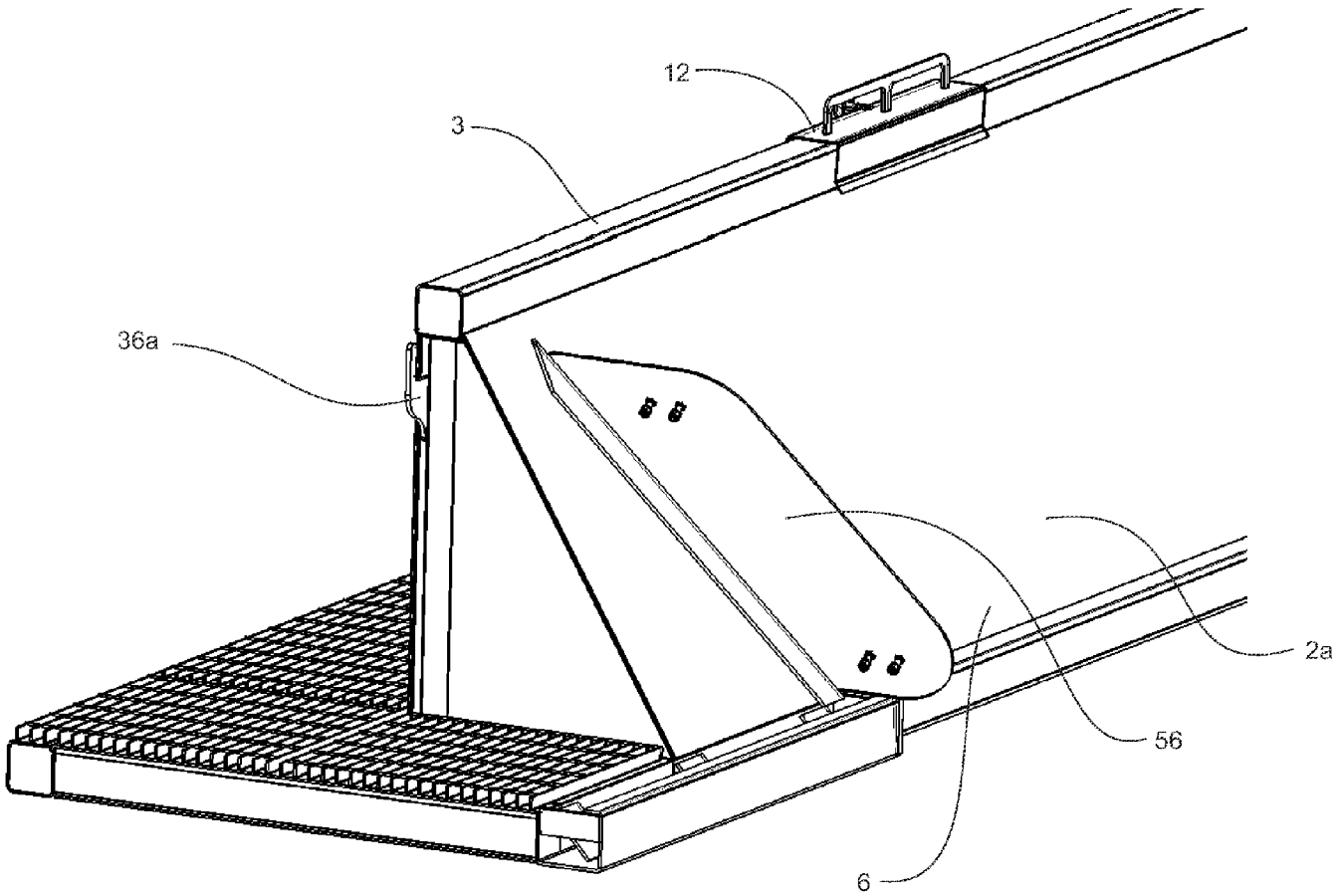
Figure 8C:
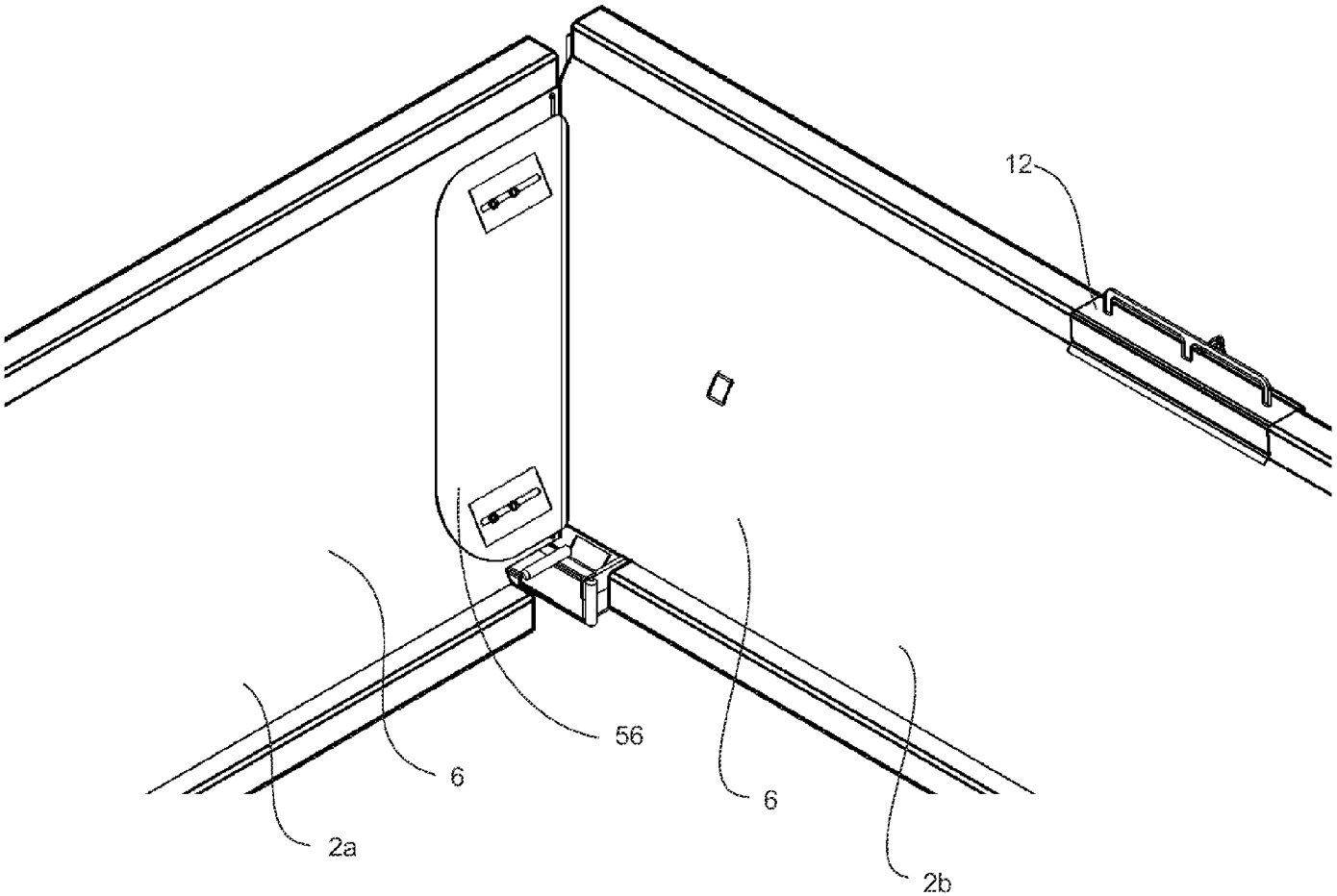
Figure 8D:
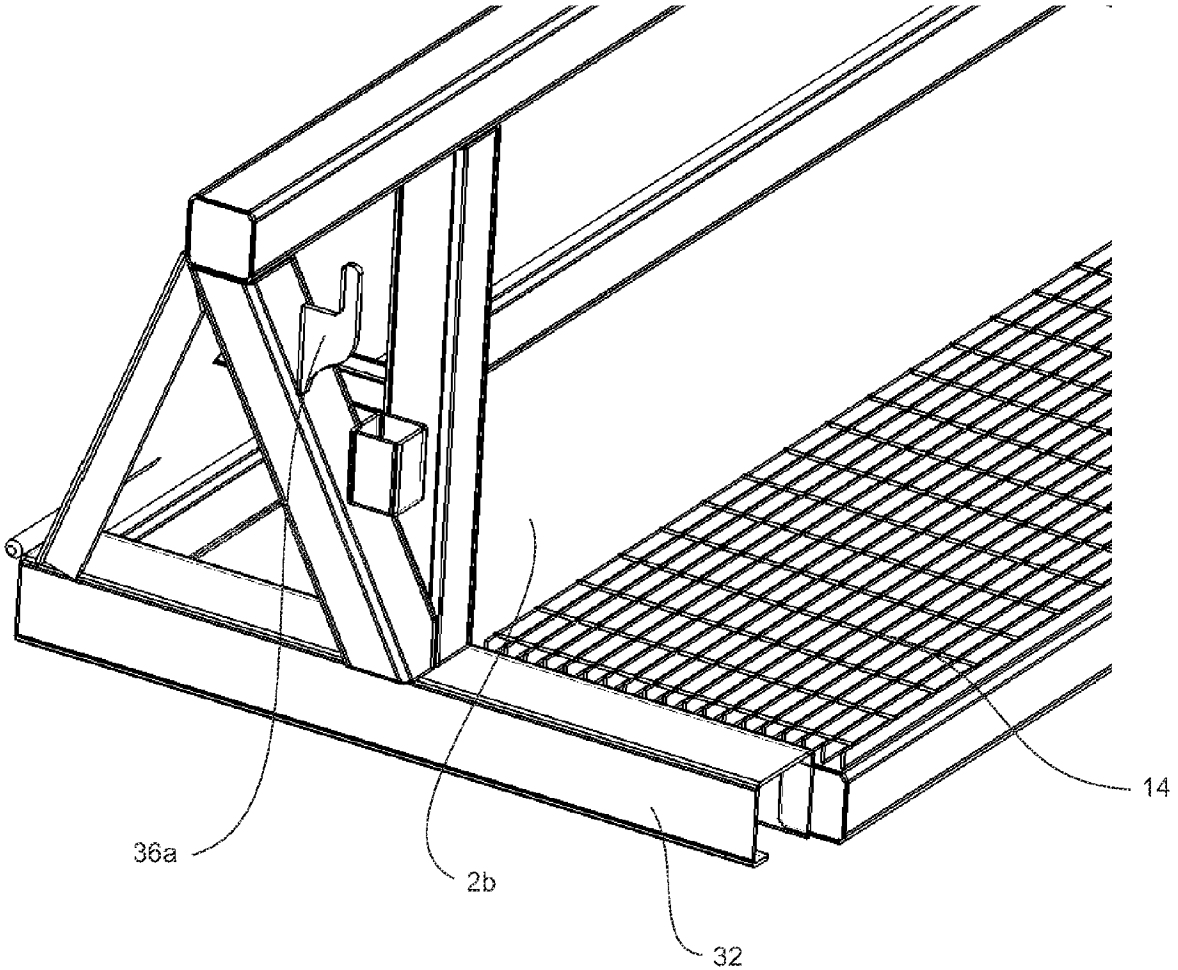
Figure 8E:
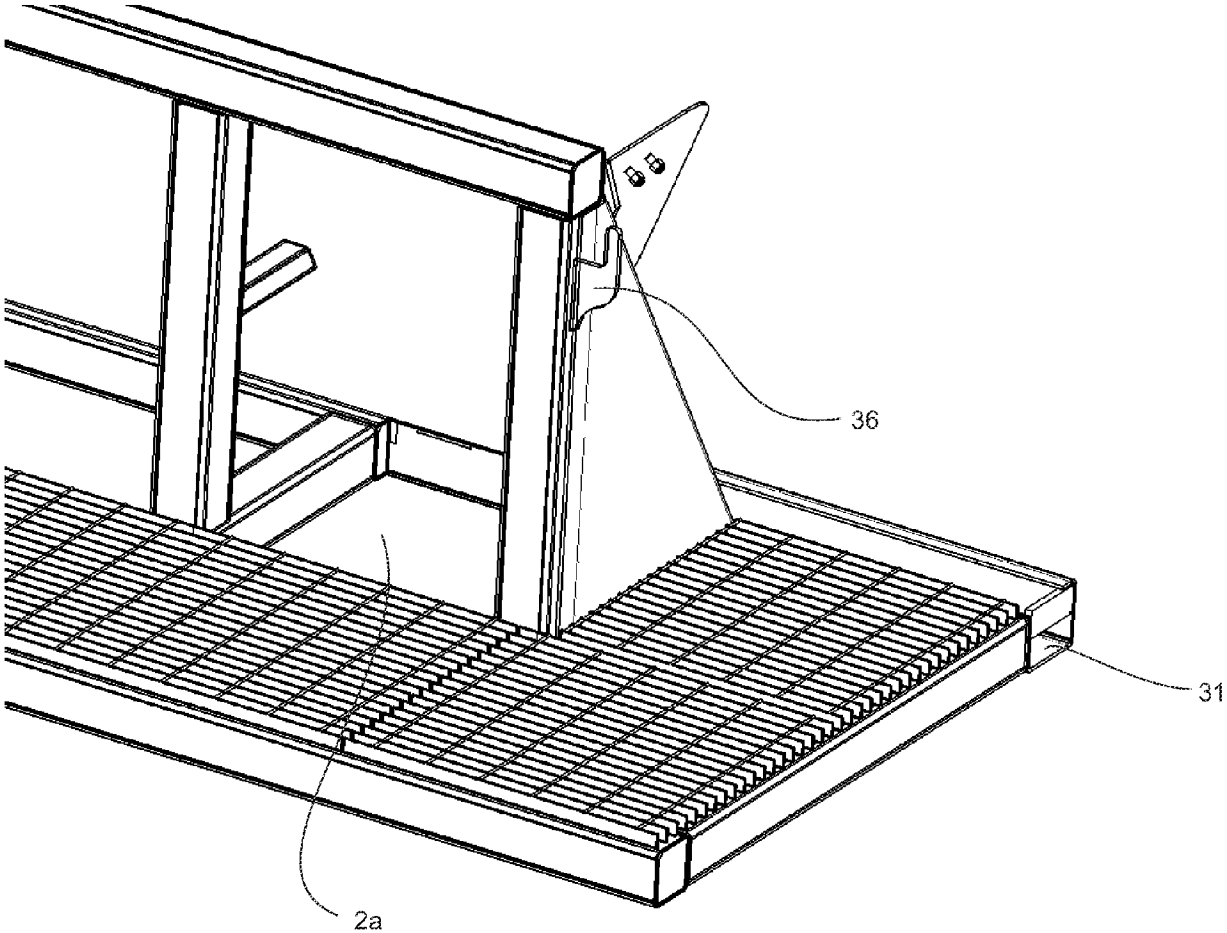

FIGS. 8A to 8E illustrate another embodiment of the corner piece 17. The corner piece is formed integrally with each of the pair of panels, one of the pair of panels arranged at a corner angle to the other of the pair of panels. In this embodiment, cooperating components of the corner piece 17 are formed integrally with adjacent rigid end panels 2*a*,2*b* arranged at an angle. A first end panel 2*a* comprises a terminating end 5*a* having an interconnection edge 54 along an inside face 55 along the bottom edge 4. The first end panel 2*a* has its planar surface 6 extending substantially to the terminating end 5*a*. A second end panel 2*b* has a terminating end 5*b* configure to conform substantially to the planar surface of the first end panel 5*a*, providing a substantially continuous supporting structure between the first and second end panels 2*a*,2*b*. One of the first and second end panels 2*a*,2*b* includes a flap 56 which covers the interface between the terminations ends 5*a*,5*b*. As shown in FIG. 8B, the flap 56 is secured along the planar surface of the first end panel 2*a*, itself being angled to correspond to the planar surface of the second end panel 5*b*. The flap 56 can have fasteners for connecting the flap 56 to the planar surface 6 of the second end panel 2*b*. Each of the end panels 2*a*,2*b* can be fit with a hook 36,36*a* respectively of the second interlock means 52 described for FIG. 7B.

The supporting surface 6 supports the liner 11 to maintain the integrity of the liner 11. In one embodiment, the rigid panel 2 is substantially continuous extending along the rigid panel 2 including a continuous sheet, or fine screen like material or lattice. The screen openings are sized such that the liner 11 does not penetrate through or herniate through the opening.

In one embodiment, the berm system 1 is a rectangular perimeter, formed of four sections at right angles. For fluid volumes in the range of 2381 barrels or 100,000 US gallons, four, 60 foot sections are interconnected using four corner pieces 23. Four, 40 foot sections contain 900 barrels or 28350 US gallons.

Each rigid panel 2 can comprises a metal frame, such as steel. In other embodiments, a metal frame can support composite material panels within the frames. One form of composite material panel is formed as described in US Patent Application Publication No. 2009/0286043 to De Baets et al. Composite material panels 2 are light weight.

In one embodiment, the liner 11 further forms or is supplemented by a thermal barrier 11*t* between the discontinuities 9 and the floor 10 of the containment area 8. Preferably, the liner 11 comprises a flexible geo-membrane associated with a liquid impermeable sheet to form both the liner 11 and the thermal barrier 11*t*. The liner/thermal barrier can be rolled or folded for ease of transport.

Rig mats can be placed over the liner 11 over the floor 10 portion of the containment area 8. The rig mat provides a level working surface for tanks and machinery located within the containment area 8. Preferably, the rig mat system is modular in construction and formed of interconnected rig mat modules.

The embodiments of the invention for which an exclusive property or privilege is claimed are defined as follows:

1. A modular berm system comprising:

a plurality of modular panels, each panel having a top edge, a base and opposing connecting ends defining a supporting surface therebetween, the panels interconnected at the opposing connecting ends of adjacent panels to form an upright perimeter wall resting upon the base on a floor of a containment area enclosed by the perimeter wall, the opposing connecting ends of the adjacent panels forming discontinuities therebetween;

a liner overlying the floor and the supporting surfaces of the perimeter wall;

a flap corresponding to each discontinuity, each flap resting on the supporting surface and extending over the discontinuity for preventing extrusion of the liner therethrough, wherein the liner forms a substantially continuous liquid barrier for retaining liquids isolated from the floor and within the containment area, the liner further extending over the top edge of the panels; and a plurality of fasteners for retaining the liner to the top edge of the panels.

2. The modular berm system of claim 1 wherein each panel has a triangular cross-section, the supporting surface being sloped upwardly and outwardly from a bottom edge of the panels away from the containment area.

3. The modular berm system of claim 1 wherein:

the panels forming the enclosing upright wall are linear between the connecting ends; and wherein the system further comprises at least three pairs of panels arranged at corners for forming the perimeter wall, each pair of panels connected at a corner piece.

4. The modular berm system of claim 3 wherein each corner piece comprises:

a frame having a base portion having a first side connecting edge and a second side connecting edge arranged at a corner angle, a first top edge and a second top edge, the first top edge and first side connection edge arranged at a corner angle to the second top edge and second side connection edge respectively;

two supporting surfaces extending from the top edges to the base and meeting along an interface to form a substantially continuous supporting surface a first interlock along the first side connecting edge and the second side connecting edge wherein the first interlock releasably connects to one panel of the pair of panels and the second interlock releasably connects to the adjacent panel of the pair of panels for forming a corner of the perimeter.

5. The modular berm system of claim 4 further comprising a substantially continuous walkway formed about the perimeter wall, each panel and corner piece having a platform extending outwardly from about the base of the panels and the base of the corner pieces, and away from the containment area.

6. The modular berm system of claim 4 wherein the first interlock further comprises:

a first U-shaped channel along each of the first and second side connecting ends; and a second inverse-oriented U-shaped channel along the connecting end of each of the panel and adjacent panel, wherein insertion of the first U-shaped channel into the second inverse U-shaped channel interlocks the corner piece with the pair of panels.

7. The modular berm system of claim 6 wherein the corner piece further comprises a second interlock to prevent lateral movement of the top edges of the corner piece relative to the top edges of the pair of panels.

8. The modular berm system of claim 7 wherein the second interlock comprises a pair of bars, each bar having a first bar end hinged to each of the first and second top edges of the corner piece and releasable received in a recess provided on the top edge of each of the pair of panels.

9. The modular berm system of claim 4 wherein the second interlock comprises a first hanger located adjacent each of the first and second side edges and a second hanger located adjacent the connecting edge of each of the pair of panels, and a rod, the rod configured to be received by the first and second hanger for interlocking the corners side edges to the panels connecting edges.

10. The modular berm system of claim 3 wherein the corner piece is formed integrally with each of the pair of panels, one of the pair of panels arranged at a corner angle to the other of the pair of panels.

11. The modular berm system of claim 1 wherein the fasteners comprise clamps for sandwiching the liner between the clamp and the top edge of the panels.

12. The modular berm system of claim 1 further comprising a substantially continuous walkway formed about the perimeter wall, each panel having a platform extending outwardly from about the base of panels and away from the containment area.

13. The modular berm system of claim 1 wherein at least one panel is an access panel, each access panel further comprising:

a doorway formed through the supporting surface for access to the enclosed containment area; and a door sill spaced above the base to provide a minimum containment depth for the containment area, the liner further extending over the door sill.

14. The modular berm system of claim 13 wherein the access panel further comprises a door for restoring the access panel to a panel without a doorway.

15. A method for installing a berm system comprising:

forming a perimeter wall enclosing a containment area by arranging a plurality of panels in an end-to-end relationship, each panel having a base, a top edge and a supporting surface, the panels interconnecting at connecting ends;

overlying the floor of the containment area with a liquid barrier layer;

extending the liquid barrier layer over the supporting surfaces and top edges of the plurality of panels;

retaining the liquid barrier layer to the top edge of the plurality panels;

accessing the containment area through a doorway formed in one or more of the panels;

extending lines through the doorway into the containment area; and passing the lines over a door sill of the doorway spaced above the floor of the containment area while retaining a minimum containment depth therein.

16. The method of claim 15 wherein the retaining of the liquid barrier layer to the top edge of the panels further comprises:

periodically clamping the liquid barrier layer to and along the top edge of the plurality of panels.

17. A modular berm system comprising:

a plurality of modular panels, each panel having a top edge, a base and opposing connecting ends defining a supporting surface therebetween, the panels interconnected at the opposing connecting ends of adjacent panels to form an upright perimeter wall resting upon the base on a floor of a containment area enclosed by the perimeter wall;

a substantially continuous walkway formed about the perimeter wall, each panel having a platform extending outwardly from about the base of panels and away from the containment area;

a liner overlying the floor and the supporting surfaces of the perimeter wall to form a substantially continuous liquid barrier for retaining liquids isolated from the floor and within the containment area, the liner further extending over the top edge of the panels; and a plurality of fasteners for retaining the liner to the top edge of the panels.

18. The system of claim 17 wherein discontinuities exist at least between connecting ends of the adjacent panels, the system further comprising a flap corresponding to each discontinuity, each flap extending over the discontinuity for preventing extrusion of the liner therethrough.

19. The system of claim 17 wherein each panel has a triangular cross-section, the supporting surface being sloped upwardly and outwardly from a bottom edge of the panels away from the containment area.

20. The system of claim 17 wherein:

the panels forming the enclosing upright wall are linear between the connecting ends; and wherein the system further comprises at least three adjacent panels arranged at corners for forming the perimeter wall, each pair of panels connected at a corner piece.

21. The system of claim 20 wherein each corner piece comprises:

a frame having a base portion having a first side connecting edge and a second side connecting edge arranged at a corner angle, a first top edge and a second top edge, the first top edge and first side connection edge arranged at a corner angle to the second top edge and second side connection edge respectively;

two supporting surfaces extending from the top edges to the base and meeting along an interface to form a substantially continuous supporting surface a first interlock along the first side connecting edge and the second side connecting edge wherein the first interlock releasably connects to one panel of the pair of panels and the second interlock releasably connects to the adjacent panel of the pair of panels for forming a corner of the perimeter.

22. The system of claim 21 wherein the first interlock further comprises a first U-shaped channel along each of the first and second side connecting ends;

a second inverse-oriented U-shaped channel along the connecting end of each of the panel and adjacent panel, wherein insertion of the first U-shaped channel into the second inverse U-shaped channel interlocks the corner piece with the pair of panels.

23. The system of claim 22 wherein the corner piece further comprises a second interlock to prevent lateral movement of the top edges of the corner piece relative to the top edges of the pair of panels.

24. The system of claim 23 wherein the second interlock comprises a pair of bars, each bar having a first bar end hinged to each of the first and second top edges of the corner piece and releasable received in a recess provided on the top edge of each of the pair of panels.

25. The system of claim 21 wherein the second interlock comprises a first hanger located adjacent each of the first and second side edges and a second hanger located adjacent the connecting edge of each of the pair of panels, and a rod, the rod configured to be received by the first and second hanger for interlocking the corners side edges to the panels connecting edges.

26. The system of claim 20 wherein the corner piece is formed integrally with each of the pair of panels, one of the pair of panels arranged at a corner angle to the other of the pair of panels.

27. The system of claim 17 wherein the fasteners comprise clamps for sandwiching the liner between the clamp and the top edge of the panels.

28. The system of claim 27 wherein each clamp comprises two legs depending from a base surface and having a width between the two legs that corresponds to a width of the top edge of the panels for straddling the top edge of the panels and sandwiching the liner therebetween.

29. The system of claim 17 wherein at least one panel is an access panel, each access panel further comprising:

a doorway formed through the supporting surface for access to the enclosed containment area; and a door sill spaced above the base to provide a minimum containment depth for the containment area, the liner further extending over the door sill.

30. The system of claim 29 wherein the access panel further comprises a door for restoring the access panel to a panel without a doorway.

31. A modular berm system comprising:

a plurality of modular panels, each panel having a top edge, a base and opposing connecting ends defining a supporting surface therebetween, the panels interconnected at the opposing connecting ends of adjacent panels to form an upright perimeter wall resting upon the base on a floor of a containment area enclosed by the perimeter wall;

a liner overlying the floor and the supporting surfaces of the perimeter wall to form a substantially continuous liquid barrier for retaining liquids isolated from the floor and within the containment area, the liner further extending over the top edge of the panels; and a plurality of fasteners for retaining the liner to the top edge of the panels, wherein at least one panel is an access panel having a doorway formed through the supporting surface for access to the enclosed containment area; and having a door sill spaced above the base to provide a minimum containment depth for the containment area, the liner further extending over the door sill.

32. The system of claim 31 wherein the access panel further comprises a door for restoring the access panel to a panel without a doorway.

33. The system of claim 31 wherein discontinuities exist at least between connecting ends of the adjacent panels, the system further comprising a flap corresponding to each discontinuity, each flap extending over the discontinuity for preventing extrusion of the liner therethrough.

34. The system of claim 31 wherein each panel has a triangular cross-section, the supporting surface being sloped upwardly and outwardly from a bottom edge of the panels away from the containment area.

35. The system of claim 31 wherein:

the panels forming the enclosing upright wall are linear between the connecting ends; and wherein the system further comprises at least three pairs of panels arranged at corners for forming the perimeter wall, each pair of panels connected at a corner piece.

36. The system of claim 31 wherein the fasteners comprise clamps for sandwiching the liner between the clamp and the top edge of the panels.

37. A modular berm system comprising:

at least three pairs of modular panels, each panel having a top edge, a base and opposing connecting ends defining a su supporting surface therebetween, the panels interconnected at the opposing connecting ends of adjacent panels of each pair of panels to form an upright perimeter wall resting upon the base on a floor of a containment area enclosed by the perimeter wall, the panels forming the enclosing upright wall being linear between the connecting ends, the panels arranged at corners for forming the perimeter wall, each pair of panels being connected at a corner piece;

a liner overlying the floor and the supporting surfaces of the perimeter wall to form a substantially continuous liquid barrier for retaining liquids isolated from the floor and within the containment area, the liner further extending over the top edge of the panels; and a plurality of fasteners for retaining the liner to the tope edge of the panels, wherein each corner piece comprises:

a frame having a base portion having a first side connecting edge and a second side connecting edge arranged at a corner angle, a first top edge and a second top edge, the first top edge and first side connection edge arranged at a corner angle to the second top edge and second side connection edge respectively;

two supporting surfaces extending from the top edges to the base and meeting along an interface to form a substantially continuous supporting surface a first interlock along the first side connecting edge and the second side connecting edge wherein the first interlock releasably connects to one panel of the pair of panels and the second interlock releasably connects to the adjacent panel of the pair of panels for forming a corner of the perimeter.

38. The system of claim 37 further comprising a substantially continuous walkway formed about the perimeter wall, each panel and corner piece having a platform extending outwardly from about the base of the panels and the base of the corner pieces, and away from the containment area.

39. The system of claim 37 wherein the first interlock further comprises:

a first U-shaped channel along each of the first and second side connecting ends; and a second inverse-oriented U-shaped channel along the connecting end of each of the panel and adjacent panel, wherein insertion of the first U-shaped channel into the second inverse U-shaped channel interlocks the corner piece with the pair of panels.

40. The system of claim 39 wherein the corner piece further comprises a second interlock to prevent lateral movement of the top edges of the corner piece relative to the top edges of the pair of panels.

41. The system of claim 40 wherein the second interlock comprises a pair of bars, each bar having a first bar end hinged to each of the first and second top edges of the corner piece and releasable received in a recess provided on the top edge of each of the pair of panels.

42. The system of claim 37 wherein the second interlock comprises a first hanger located adjacent each of the first and second side edges and a second hanger located adjacent the connecting edge of each of the pair of panels, and a rod, the rod configured to be received by the first and second hanger for interlocking the corners side edges to the panels connecting edges.

43. The system of claim 37 wherein the corner piece is formed integrally with each of the pair of panels, one of the pair of panels arranged at a corner angle to the other of the pair of panels.

44. A modular berm system comprising:

at least three pairs of modular panels, each panel having a top edge, a base and opposing connecting ends defining a supporting surface therebetween, the panels interconnected at the opposing connecting ends of adjacent panels of each pair of panels to form an upright perimeter wall resting upon the base on a floor of a containment area enclosed by the perimeter wall, each panel having a triangular cross-section, the supporting surface being sloped upwardly and outwardly from a bottom edge of the panels away from the containment area, the panels forming the enclosing upright wall being linear between the connecting ends, the panels arranged at corners for forming the perimeter wall, each pair of panels being connected at a corner piece, the corner piece being formed integrally with each of the pair of panels, a terminating end of one end of the pair of panels configured to conform substantially to the sloped supporting surface and arranged at a corner angle to the other of the pair of panels;

a liner overlying the floor and the supporting surfaces of the perimeter wall to form a substantially continuous liquid barrier for retaining liquids isolated from the floor and within the containment area, the liner further extending over the top edge of the panels; and a plurality of fasteners for retaining the liner to the top edge of the panels.

45. The system of claim 44 wherein discontinuities exist at least between connecting ends of the adjacent panels, the system further comprising a flap corresponding to each discontinuity, each flap extending over the discontinuity for preventing extrusion of the liner therethrough.

46. The system of claim 44 wherein:

the panels forming the enclosing upright wall are linear between the connecting ends; and wherein the system further comprises at least three pairs of panels arranged at corners for forming the perimeter wall, each pair of panels connected at a corner piece.

47. The system of claim 44 further comprising a substantially continuous walkway formed about the perimeter wall, each panel having a platform extending outwardly from about the base of the panels and away from the containment area.

48. The system of claim 44 wherein at least one panel is an access panel, each access panel further comprising:

a doorway formed through the supporting surface for access to the enclosed containment area;

a door sill spaced above the base to provide a minimum containment depth for the containment area, the liner further extending over the door sill; and a door for restoring the access panel to a panel without a doorway.

* * * * *